US007451730B2

(12) United States Patent
Nguyen et al.

(10) Patent No.: US 7,451,730 B2
(45) Date of Patent: Nov. 18, 2008

(54) METHOD FOR ADJUSTING THE POSITION OF THE ANGLE OF ROTATION OF THE CAMSHAFT OF A RECIPROCATING PISTON INTERNAL COMBUSTION ENGINE IN RELATION TO THE CRANKSHAFT

(75) Inventors: Minh Nam Nguyen, Buehl (DE); Holger Stork, Buehl (DE); Helko Dell, Wuestenrot (DE)

(73) Assignee: Schaeffler KG (DE)

( * ) Notice: Subject to any disclaimer, the term of this patent is extended or adjusted under 35 U.S.C. 154(b) by 0 days.

(21) Appl. No.: 11/577,619

(22) PCT Filed: Sep. 28, 2005

(86) PCT No.: PCT/DE2005/001720

§ 371 (c)(1),
(2), (4) Date: Apr. 20, 2007

(87) PCT Pub. No.: WO2006/042494

PCT Pub. Date: Apr. 27, 2006

(65) Prior Publication Data

US 2007/0245989 A1 Oct. 25, 2007

(30) Foreign Application Priority Data

Oct. 20, 2004 (DE) ..... 10 2004 051 000

(51) Int. Cl.
*F01L 1/34* (2006.01)

(52) U.S. Cl. ..... 123/90.17; 123/90.15; 123/347; 464/160

(58) Field of Classification Search ..... 123/90.15, 123/90.16, 90.17, 90.18, 90.27, 90.31, 345, 123/346, 347, 348, 406.58, 406.62; 464/1, 464/2, 160; 701/101, 110
See application file for complete search history.

(56) References Cited

U.S. PATENT DOCUMENTS

| | | | | |
|---|---|---|---|---|
| 5,289,805 | A | 3/1994 | Quinn, Jr. et al. | |
| 7,222,593 | B2 * | 5/2007 | Stork et al. | 123/90.15 |
| 2003/0000498 | A1 | 1/2003 | Mathews | |

FOREIGN PATENT DOCUMENTS

| | | | |
|---|---|---|---|
| DE | 100 38 354 | A | 2/2002 |
| DE | 102 36 507 | A | 2/2004 |
| DE | 102 44 540 | A | 4/2004 |
| DE | 103 07 307 | A | 9/2004 |
| EP | 1 375 833 | A | 1/2004 |
| JP | 2002 161763 | A | 6/2002 |

* cited by examiner

*Primary Examiner*—Ching Chang
(74) *Attorney, Agent, or Firm*—Lucas & Mercanti, LLP

(57) ABSTRACT

In a method for setting the rotary-angle position of the camshaft of a reciprocating piston internal combustion engine relative to the crankshaft, in which the crankshaft has a drive connection to the camshaft via an adjusting gear which is embodied as a triple shaft gear with a drive shaft which is fixed to the crankshaft, an output shaft which is fixed to the camshaft and an adjusting shaft, a phase angle signal for the rotary-angle position of the camshaft relative to the crankshaft is registered. Travel up to a stop is carried out, during which a stop element which is connected to the drive shaft is moved towards a counterstop element which is connected to the camshaft.

11 Claims, 3 Drawing Sheets

Figure 1:
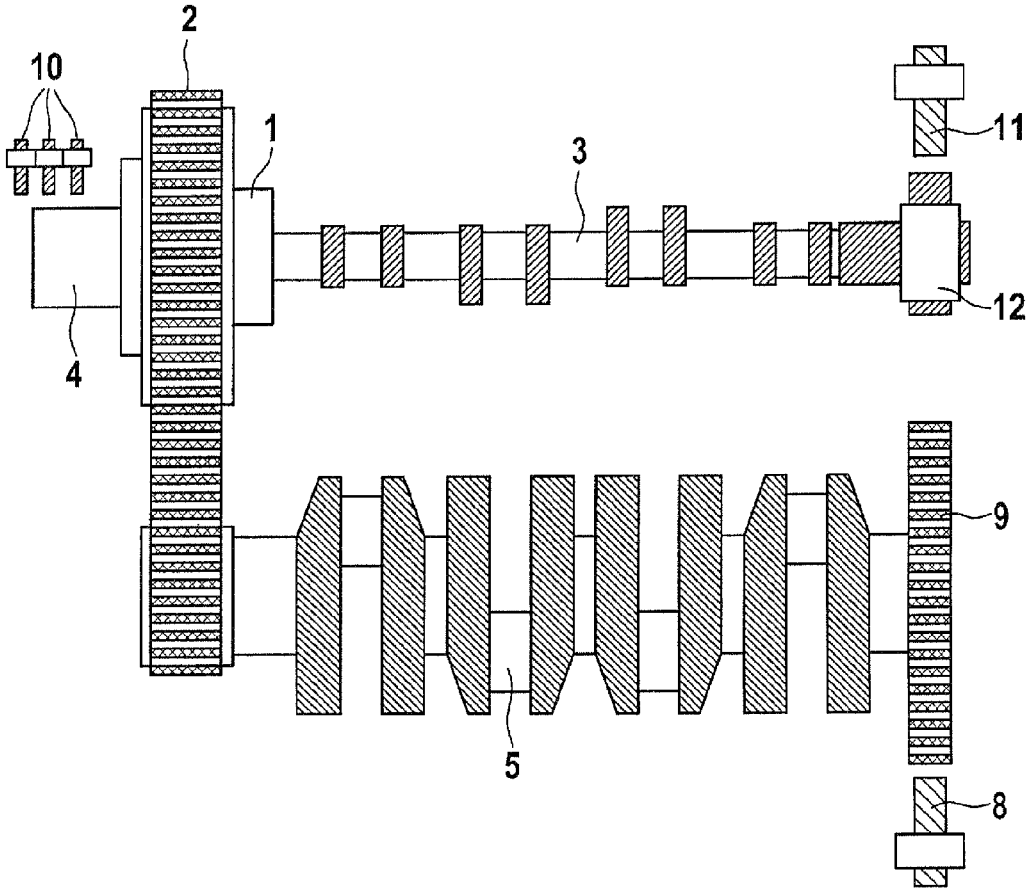

METHOD FOR ADJUSTING THE POSITION OF THE ANGLE OF ROTATION OF THE CAMSHAFT OF A RECIPROCATING PISTON INTERNAL COMBUSTION ENGINE IN RELATION TO THE CRANKSHAFT

The invention relates to a method for setting the rotary-angle position of the camshaft of a reciprocating piston internal combustion engine relative to the crankshaft, wherein the crankshaft has a drive connection to the camshaft via an adjusting gear which is embodied as a triple shaft gear with a drive shaft which is fixed to the crankshaft, an output shaft which is fixed to the camshaft and an adjusting shaft, wherein a phase angle signal for the rotary-angle position of the camshaft relative to the crankshaft is registered, wherein travel up to a stop is carried out in which a stop element which is connected to the drive shaft is moved towards a counterstop element which is connected to the camshaft, while the adoption of a stop position is monitored, wherein, when the stop position is detected, a stop phase angle value is determined, and wherein a setpoint phase angle signal is made available and the phase angle signal is adjusted to the setpoint phase angle signal.

Such a method is known from the practice. In said method the rotary-angle position of the camshaft relative to the crankshaft is adjusted using an electric motor which drives an adjusting shaft of a triple shaft gear which is arranged between the crankshaft and the camshaft. A camshaft gearwheel, which is driven via a chain by a crankshaft gearwheel which is connected in a rotationally fixed fashion to the crankshaft, is provided on the drive shaft of the triple shaft gear. The output shaft of the triple shaft gear is connected in a rotationally fixed fashion to the camshaft. In order to adjust the rotary position or phase angle of the camshaft relative to the crankshaft to a setpoint phase angle signal which is made available, the phase angle is measured and compared with the setpoint value signal. When a deviation occurs, the electric motor is actuated in such a way that the deviation is reduced. So that even in the event of a fault in the adjustment device the functioning of the motor can be maintained, the relative adjustment is limited to a maximum adjustment angle using a stop element which is connected to the drive shaft and interacts with a counterstop element which is fixed to the camshaft.

Since the location of the stop position is not yet known when the internal combustion engine starts, travel up to a stop is carried out during the starting process of the internal combustion engine, during which travel the stop element is moved, by correspondingly rotating the adjusting shaft, towards the counterstop element until the stop element comes to bear against the counterstop element. In the process, the adoption of the stop position is monitored by sensors. As soon as it is detected that the stop element is positioned against the counterstop element, a phase angle value is assigned to the stop position. This may be done, for example, in such a way that the phase angle signal at the stop position is read out and the corresponding measured value is used as a phase angle value for the stop position. However, there is also the possibility of setting the phase angle signal to zero when the stop position has been reached. In this case, the stop position forms the reference point for the phase angle signal.

The setpoint phase angle signal is made available by an engine control device which controls the reciprocating piston internal combustion engine. The setpoint phase angle signal is selected as a function of the operating state of the internal combustion engine in such a way that the reciprocating piston internal combustion engine has favourable fuel consumption and low emission of pollutants. The phase angle signal is adjusted to this setpoint phase angle signal in that, when a deviation occurs between the phase angle signal and the setpoint phase angle signal, the adjusting shaft is rotated in such a way that the deviation is reduced. The setpoint phase angle signal is limited as a function of the stop phase angle value in such a way that a collision between the stop element and the counterstop element is avoided during normal operation of the internal combustion engine. However in practice it has become apparent that the stop position can change during the operation of the reciprocating piston internal combustion engine so that said position then no longer corresponds to the stop phase angle value determined during the starting process. In order, nevertheless, to avoid a collision between the stop element and the counterstop element, and thus to avoid the risk of damage to the corresponding parts, in the operating states which occur during normal operation, it is necessary, when limiting the phase angle, to maintain a certain safety interval from the stop phase angle value, as a result of which the adjustment range which is available for setting the phase angle cannot be used completely.

The object is therefore to provide a method of the type mentioned at the beginning which makes it possible to adapt the stop phase angle value to changes in the operating state of the internal combustion engine.

This object is achieved by virtue of the fact that the stop phase angle value is assigned an adjacent or neighbouring phase angle range and the phase angle signal is compared with the phase angle range, and in that if the setpoint phase angle signal is within the phase angle range, the adjustment of the phase angle signal to the setpoint phase angle signal is interrupted and further travel up to a stop is carried out during which the stop element is moved towards the counterstop element while the adoption of the stop position is monitored, in that, when the stop position is detected, the stop phase angle value is determined again, and in that the adjustment of the phase angle signal to the setpoint phase angle signal is then continued.

It is thus advantageously possible, during normal operation of the reciprocating piston internal combustion engine, to determine the stop phase angle value again in order, for example, to adapt it to changed operating conditions of the internal combustion engine. In this context, the travel up to a stop is implemented if the setpoint phase angle signal is located in the vicinity of a stop phase angle value which was determined at an earlier time, for example during the last travel up to a stop so that during the travel up to a stop only a relatively small deviation of the phase angle signal from the setpoint phase angle signal occurs and the travel up to a stop thus has virtually no effect on the fuel consumption, the emission of pollutants or the other operating behaviour of the reciprocating piston internal combustion engine. The travel up to a stop is therefore implemented without the user of the internal combustion engine being aware of it. The stop phase angle value can be used as a reference point for the phase angle signal and/or to limit the phase angle while the phase angle signal is being adjusted.

In one advantageous embodiment of the invention, the setpoint phase angle signal is compared with the phase angle range during the travel up to a stop, wherein, if the setpoint phase angle signal leaves the phase angle range, the travel up to a stop is aborted and the adjustment of the phase angle signal to the setpoint phase angle signal is resumed. If a deviation between the setpoint phase angle signal and the phase angle range occurs, this deviation is therefore immediately compensated by resuming the phase angle adjustment. In this context, aborting of the travel up to a stop is allowed for. This can then be recovered, if appropriate, at a later time when the setpoint phase angle signal is within the phase angle range again.

In one expedient refinement of the invention, the time which has passed since the last travel up to a stop is measured and compared with a predefined minimum time period, wherein the implementation of further travel up to a stop is suppressed as long as the minimum time period has not yet been reached. It is assumed in this context that no significant change in the stop position is to be expected within the minimum time period. Unnecessary travel up to a stop is therefore avoided.

It is particularly advantageous if at least one operating state variable of the internal combustion engine, in particular its operating temperature and/or crankshaft rotational speed is registered, if travel up to a stop is implemented in different operating states, if the stop phase angle values which are respectively determined for the individual operating states are stored in a data memory, and if a stop phase angle value is then determined for an operating state by reading out a stop phase angle value from the data memory as a function of the at least one operating state variable and using it to limit the phase angle signal and/or setpoint phase angle signal and/or as a reference point for the phase angle signal. A characteristic diagram is therefore learnt which can have, for example, as parameters, the cooling water temperature and/or oil temperature of the internal combustion engine and/or the rotational speed of the crankshaft. By using the stop phase angle values which are learnt in this way it is possible to adapt the stop phase angle value in a simple way to a change in the operating state of the internal combustion engine without travel up to a stop having to be carried out again for this purpose. The characteristic diagram is expediently stored in a nonvolatile data memory such as, for example, an EEProm so that it is still available after the internal combustion engine restarts. When the internal combustion engine is first put into operation, the data memory can have previously stored standard values.

In one preferred embodiment of the invention, the difference between the phase angle signal and the stop phase angle value is determined, with the setpoint phase speed signal being changed as a function of the difference, and in particular being reduced when the difference decreases. As a result, wear on the stop element and the counterstop element is very largely avoided during the travel up to a stop. Nevertheless, the stop position can be found quickly.

In order to protect the stop element and counterstop element against damage it is possible to limit the rotational speed of the adjusting shaft during the travel up to a stop. This measure is possible particularly if the phase angle is within a predefined surrounding area of the stop phase angle value.

An electric motor is preferably provided for driving the adjusting shaft, wherein the operating current and/or the operating voltage of the electric motor are limited during the travel up to a stop. This measure also allows damage to the stop element and/or counterstop element to be avoided. The operating current and/or the operating voltage of the electric motor can be limited by pulse width modulation.

Figure 2:
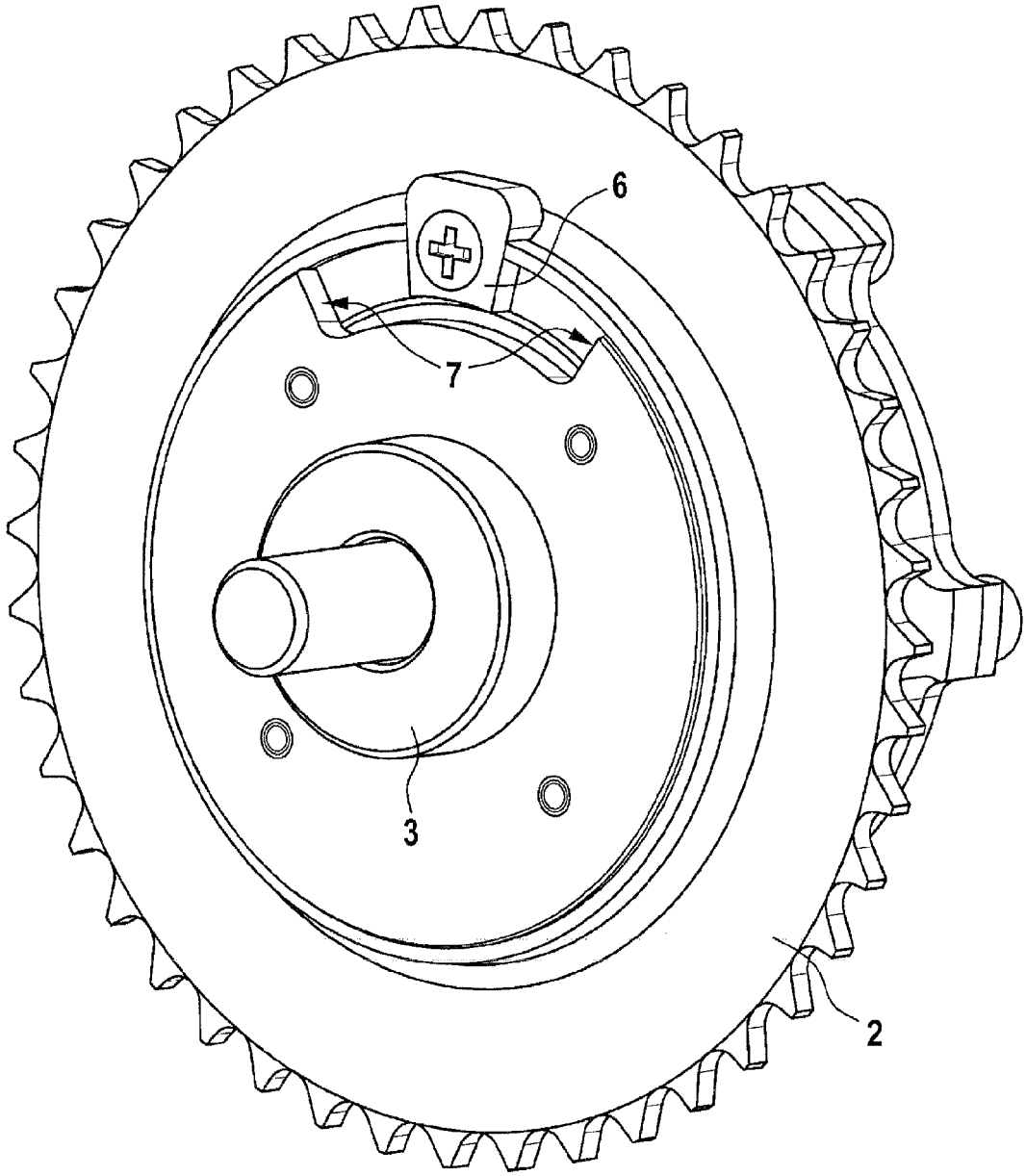
Figure 3:
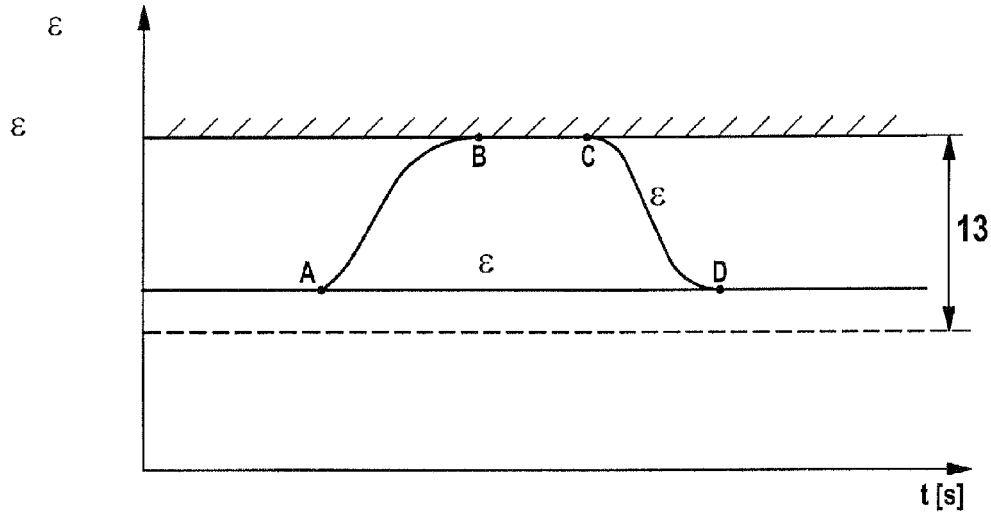
Figure 4:
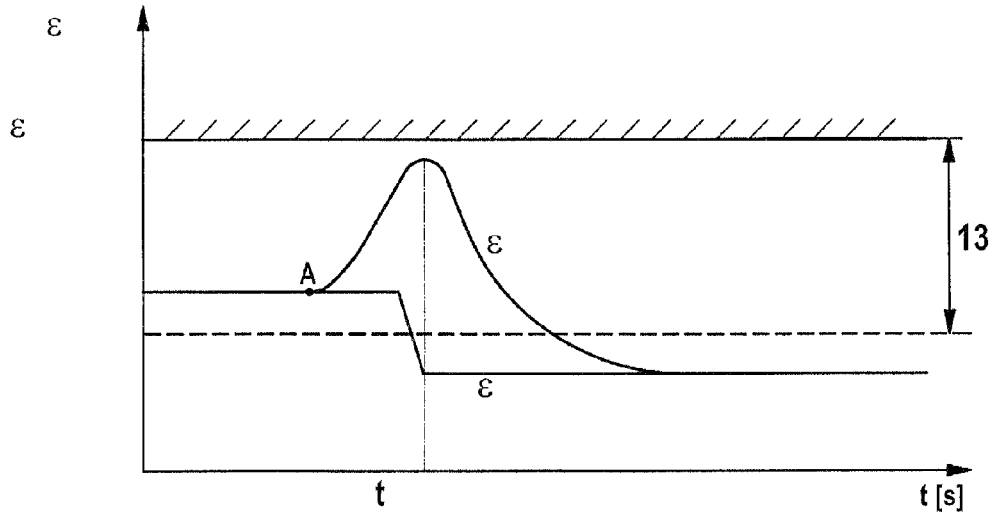

An exemplary embodiment of the invention will be explained in more detail below with reference to the drawing, in which:

FIG. 1 is a schematic partial illustration of a reciprocating piston internal combustion engine which has a device for setting the phase angle of the camshaft relative to the crankshaft, FIG. 2 is a camshaft adjusting device, FIG. 3 is a graphic illustration of a phase angle signal and of a setpoint phase angle signal during travel up to a stop, wherein the time is plotted in seconds on the abscissa and the signal amplitude on the ordinate, and FIG. 4 is an illustration similar to FIG. 3 but here the travel up to a stop is aborted prematurely.

An adjusting device for the rotary-angle position of the camshaft 3 relative to the crankshaft 5 of a reciprocating piston internal combustion engine has, according to FIG. 1, an adjusting gear 1 which is embodied as a triple shaft gear with a driveshaft which is fixed to the crankshaft, an output shaft which is fixed to the camshaft and an adjusting shift. The adjusting gear can be an epicyclic gear, preferably a planetary gear.

The drive shaft is connected in a rotationally fixed fashion to a camshaft gearwheel 2 which has a drive connection in a fashion known per se via a chain or a toothed belt to a crankshaft gearwheel which is arranged in a rotationally fixed fashion on the crankshaft 5 of the internal combustion engine. The output shaft is connected in a rotationally fixed fashion to the camshaft 3. The adjusting shaft is connected in a rotationally fixed fashion to the rotor of an electric motor 4. The adjusting gear 1 is integrated in the hub of the camshaft gearwheel 2.

So that the rotational angle between the camshaft 3 and the crankshaft 5 is limited in the case of a fault in the actuation of the electric motor 4 and a collision 9 between the valves and the reciprocating pistons is reliably avoided, the adjusting device has a stop element 6, permanently connected to the drive shaft of the adjusting gear 1, and a counterstop element 7 which is connected to the camshaft 3 in a rotationally fixed fashion and comes to bear against the stop element 4 in a stop position in the position of use.

FIG. 1 shows that, in order to measure the crankshaft rotational angle, a magnetic detector 8 is provided which detects the tooth edges of Y a crown gear 9 which is composed of a magnetically permeable material and is arranged on the crankshaft 5. One of the tooth gaps or teeth of the crown gear 9 has a larger width than the other tooth gaps or teeth and marks a reference rotary-angle position of the crankshaft 5.

When the reference rotary-angle position is reached, a reference mark is generated in the sensor signal of the magnetic detector 8, which is also referred to below as crankshaft sensor signal. This is achieved by virtue of the fact that the crankshaft crown gear 9 has a larger gap at the reference rotary-angle position than between its other teeth. As soon as the reference mark in the crankshaft sensor signal is detected, a rotary-angle measurement signal is set to a value assigned to the reference rotary-angle position. The rotary-angle measurement signal is then correspondingly adjusted whenever there is a change in the state of the crankshaft sensor signal by virtue of the fact that an interrupt is triggered in an operating program of the control unit and the rotary-angle measurement signal is incremented in said interrupt.

An EC motor which has a rotor on whose circumference is arranged a row of magnet segments which interact magnetically via an airgap with teeth of a stator and which are magnetized alternately in opposite directions with respect to one another is provided as the electric motor 4. The teeth are would with a winding which is energized via an actuation device.

The position of the magnet segments relative to the stator and thus the adjusting shaft rotary-angle are detected using the measuring device which has, on the stator, a plurality of magnetic field sensors 10 which are arranged offset with respect to one another in a circumferential direction of the stator in such a way that a number of magnet segment/sensor combinations is run through at every revolution of the rotor. The magnetic field sensors 10 generate a digital sensor signal which runs through a sequence of sensor signal states which, when there is a fall mechanical rotation of the rotor, is repeated the same number of times as the number of magnetic field sensors 10 of the measuring device. This sensor signal is also referred to below as adjusting shaft sensor signal.

When the internal combustion engine starts, a position measurement signal is set to a position measurement signal start value independently of the position in which the rotor or the adjusting shaft is currently located. The adjusting shaft is then rotated, during which process an interrupt is triggered in the operating program of the control unit at each change of state of the adjusting shaft sensor signal, and the position measurement signal is correspondingly adjusted at said interrupt.

A Hall sensor 11, which interacts with a trigger wheel 12 which is arranged on the camshaft 3, is provided as a reference signal transmitter for the camshaft rotary angle. When a predefined rotary-angle position of the camshaft 3 is reached, a signal edge is generated in a camshaft reference signal. If the Hall sensor 11 detects the signal edge, an interrupt is triggered in an operating program of a control unit and the crankshaft rotary angle and the adjusting shaft rotary angle are buffered at said interrupt for the purpose of adjusting the phase angle in order to carry out further processing. This interrupt is also referred to below as camshaft interrupt. Finally, in the operating program of the control unit, a time slot-controlled interrupt, which is referred to below as a cyclical interrupt, is also triggered.

The current phase angle $\epsilon_{act}(t)$ is calculated using the crankshaft rotary-angle measurement signal, the position measurement signal and a gear characteristic variable, specifically the transmission ratio of the adjusting gear 1 when the drive shaft is stationary between the adjusting shaft and the camshaft 3:

$$\varepsilon_{act}(t) = \varepsilon_{\mathrm{Abs}} + \frac{1}{-i_g} \cdot (2 \cdot [\varphi_{Em,1Cyc} - \varphi_{Em,1Cam}] - [\varphi_{Cnk,1Cyc} - \varphi_{Cnk,1Cam}])$$

Where

- $\phi_{Em,1Cyc} = \phi_{Em}(t_{1Cyc})$ is the rotary angle of the rotor of the electric motor 4 from the last detected crankshaft reference mark up to the current cyclical interrupt
- $\phi_{Cnk,1Cyc} = \phi_{Cnk}(t_{1Cyc})$ is the rotary angle of the crankshaft 5 from the last detected crankshaft reference mark up to the current cyclical interrupt
- $\phi_{Em,1Cam}$ is the rotary angle of the rotor of the electric motor 4 from the last detected crankshaft reference mark up to the last camshaft interrupt
- $\phi_{Cnk,1Cam}$ is the rotary angle of the crankshaft 5 from the last detected cranks-haft reference mark up to the last camshaft interrupt, and
- $\epsilon_{Abs}$ is the absolute phase angle which is determined at each camshaft interrupt by measurement and is equal to the crankshaft rotary angle $\phi_{Cnk,1Cyc}$ at this time.

The phase angle signal $\epsilon_{act}$ is therefore correspondingly adjusted starting from a reference rotary-angle value when there is a change in state of the crankshaft sensor signal and/or of the adjusting shaft sensor signal. The phase angle signal $\epsilon_{act}$ which is determined in this way is adjusted to a setpoint phase angle signal $\epsilon_{setp}$ which is made available by an engine control unit.

After the internal combustion engine starts, at first it takes a certain Lime until the reference mark in the crankshaft sensor signal is detected and a signal edge is detected, in the camshaft reference signal. In order, nevertheless, to be able to determine a reference rotary-angle value for the phase angle signal $\epsilon_{act}$ as early as possible, at first travel up to a stop is carried out, during which the stop element 6 is moved, by correspondingly actuating the electric motor 4, towards the counterstop element 7 until the stop position has been reached. During the travel up to a stop, the adoption of the stop position is monitored by virtue of the tact that the phase angle signal $\epsilon_{act}$ is used to determine the phase speed and to detect a reduction in the phase speed occurring at the stop position. As soon as the phase angle value $\epsilon_{stop}$ for the stop position is known, the phase angle signal $\epsilon_{act}$ is measured with respect to this phase angle and is adjusted to the setpoint phase angle signal $\epsilon_{setp}$.

After the reference mark in the crankshaft sensor signal has boon reliably detected and the signal edge in the camshaft reference signal has been reliably detected, the further phase angle signal $\epsilon_{act}$ is measured with respect to the reference mark and the camshaft signal edge. As a result, compared to the phase angle measurement which is referred to the stop position and which can have measurement errors, for example when there are tolerances in the chain or the toothed belt and/or a chain tensioner or toothed belt tensioner of the camshaft drive, a greater degree of measuring accuracy is achieved. These tolerances are dependent, inter alia, on the operating temperature of the internal combustion engine (thermally induced change in length of the chain or of the toothed belt) and the rotational speed of the crankshaft which influences the centrifugal forces on the chain or the toothed belt.

In order to reduce the wear on the stop element 6 and the counterstop element 7, the phase angle signal $\epsilon_{act}$ is limited as a function of the stop phase angle value $\epsilon_{stop}$ in such a way that a collision between the stop element 6 and the counterstop element 7 is avoided during the normal operation of the internal combustion engine.

So that the existing phase angle adjusting range of the adjusting device can be utilized as well as possible, a characteristic diagram is learnt for the stop phase angle value $\epsilon_{Stop}$ while the in internal combustion engine is operating, and is stored in a data memory in which a stop phase angle value $\epsilon_{Stop}$ is respectively stored for different operating temperatures and/or crankshaft rotational speeds. A stop phase angle value $\epsilon_{Stop}$ is then determined using the characteristic diagram, in each case as a function of the operating temperature and/or crankshaft rotational speed, and is used to limit the phase angle signal $\epsilon_{act}$. The learning of the characteristic diagram also takes into account wear-induced changes in the crank drive, for example the elongation of the chain or of the toothed belt or reduction in the chain tension or toothed belt tension when the stop phase angle value $\epsilon_{Stop}$ is being measured.

So that the operation of the internal combustion engine is virtually unaffected in an adverse way by the learning of the characteristic diagram, the stop phase angle value $\epsilon_{Stop}$ is assigned a phase angle range which is adjacent to the stop phase angle value $\epsilon_{Stop}$. In FIGS. 3 and 4, this phase angle range is marked by a double arrow 13. During normal operation of the internal combustion engine, the setpoint phase angle signal $\epsilon_{setp}$ which is made available by the engine control unit is compared with the phase angle range.

If the setpoint phase angle signal $\epsilon_{setp}$ lies, as shown in FIG. 3, within the phase angle range, the adjustment of the phase angle signal $\epsilon_{act}$ to the setpoint phase angle signal $\epsilon_{setp}$ is interrupted and a further travel up to a stop is carried out insofar as the engine controller permits it. For this purpose, the stop element 6 is moved towards the counterstop element 7 starting from the setpoint phase angle just set. In FIG. 3 it is apparent that the electric motor 4 is actuated during the travel up to a stop such that the phase speed at first rises in terms of absolute value, starting from the position of the phase angle signal $\epsilon_{act}$ designated by A, and then decreases again as it approaches the stop phase angle value $\epsilon_{Stop}$ until the stop element 6 comes to bear against the counterstop element 7 at the position designated by B.

During the travel up to a stop, the adoption of the stop position is monitored again by virtue of the fact that a decrease in the phase speed which occurs at the stop position is detected, while the electric motor continues to be energized in the direction of the counterstop element 7. As soon as the new phase angle value $\epsilon_{Stop}$ is known, the adjustment of the phase angle signal $\epsilon_{act}$ to the setpoint phase angle signal $\epsilon_{setp}$ is resumed. It is clearly apparent that the phase speed at first rises in terms of absolute value starting from the position of the phase angle signal $\epsilon_{act}$ designated by C and then decreases again when the setpoint phase angle signal $\epsilon_{setp}$ is approached, until the phase angle signal $\epsilon_{act}$ corresponds to the setpoint phase angle signal $\epsilon_{setp}$ at the location designated by D.

In the exemplary embodiment shown in FIG. 4, during travel up to a stop the phase angle signal $\epsilon_{act}$ leaves the phase angle range marked with a double arrow 13. During the travel up to a stop, the setpoint phase angle signal $\epsilon_{setp}$ is continuously compared with a phase angle range and after each comparison it is checked whether the setpoint phase angle signal s, $\epsilon_{setp}$ is still within the phase angle range and the travel up to a stop is still permissible. If it is detected during the checking that the setpoint phase angle signal $\epsilon_{setp}$ is outside the phase angle range, the travel up to a stop is aborted and the adjustment of the phase angle signal $\epsilon_{net}$ to the setpoint phase angle signal $\epsilon_{setp}$ is resumed. In FIG. 4 it is clear that, before the stop position has been reached, the phase angle signal $\epsilon_{act}$ moves away again from the stop phase angle value $\epsilon_{Stop}$, starting from she time designated by $t_{Abort}$.

As has already been mentioned, the measured stop phase angle value $\epsilon_{Stop}$ are stored in the form of a characteristic diagram in a data memory. For this purpose, at every travel up to a stop the operating state variables on which the characteristic diagram is dependent are respectively determined and a storage location in the data memory at which the stop phase angle value $\epsilon_{Stop}$ is stored is assigned to the respective stop phase angle value $\epsilon_{Stop}$ as a function of the operating state variables. If the measured stop phase angle value $\epsilon_{Stop}$ is implausible, the storage of the stop phase angle value $\epsilon_{Stop}$ is suppressed.

After each instance of travel up to a stop during which a plausible stop phase angle value $\epsilon_{Stop}$ has been measured, a timer which measures the time which has passed since the last instance of travel up to a stop is reset. Before further travel up to a stop is carried out, the time which is measured by the timer is first read out and compared with a predefined minimum time period. As long as the minimum time period has not yet been reached, the implementation of further travel up to a stop is suppressed.

LIST OF REFERENCE SYMBOLS

1 Adjusting gear
2 Camshaft gearwheel
3 Camshaft
4 Electric motor
5 Crankshaft
6 Stop element
7 Counterstop element
8 Magnetic detector
9 Crown gear
10 Magnetic field sensor
11 Hall sensor
12 Trigger wheel
13 Double arrow
$\epsilon_{act}$ Phase angle signal
$\epsilon_{setp}$ Setpoint phase angle signal
$\epsilon_{Stop}$ Stop phase angle value

The invention claimed is:

1. A method for setting the rotary-angle position of the camshaft of a reciprocating piston internal combustion engine relative to the crankshaft, wherein the crankshaft has a drive connection to the camshaft via an adjusting gear which is embodied as a triple shaft gear with a drive shaft which is fixed to the crankshaft, an output shaft which is fixed to the camshaft and an adjusting shaft, wherein a phase angle signal ($\epsilon_{act}$) for the rotary-angle position the camshaft relative to the crankshaft is registered, wherein travel up to a stop is carried out during which a stop element which is connected to the drive shaft is moved towards a counterstop element which is connected to the camshaft, while the adoption of a stop position is monitored, wherein, when the stop position is detected, a stop phase angle value ($\epsilon_{stop}$) is determined, and wherein a setpoint phase angle signal ($\epsilon_{setp}$) is made available and the phase angle signal ($\epsilon_{act}$) is adjusted to the setpoint phase angle signal ($\epsilon_{setp}$), wherein the stop phase angle value ($\epsilon_{stop}$) is assigned an adjacent or neighbouring phase angle range and the phase angle signal ($\epsilon_{act}$) is compared with the phase angle range, and that if the setpoint phase angle signal ($\epsilon_{setp}$) is within the phase angle range, the adjustment of the phase angle signal ($\epsilon_{act}$) to the setpoint phase angle signal ($\epsilon_{setp}$) is interrupted and further travel up to a stop is carried out during which the stop element is moved towards the counterstop element while the adoption of the stop position is monitored, wherein, when the stop position is detected the stop phase angle value ($\epsilon_{stop}$) is determined again, and wherein the adjustment of the phase angle signal ($\epsilon_{act}$) to the setpoint phase angle signal ($\epsilon_{setp}$) is then continued.

2. The method according to claim 1, wherein during the travel up to a stop, the setpoint phase angle signal ($\epsilon_{setp}$) is compared with the phase angle range, and if the setpoint phase angle signal ($\epsilon_{setp}$) leaves the phase angle range, the travel up to a stop is aborted and the adjustment of the phase angle signal ($\epsilon_{act}$) to the setpoint phase angle signal ($\epsilon_{setp}$) is resumed.

3. The method according to claim 1, wherein the time which has passed since the last travel up to a stop is measured and is compared with a predefined minimum time period, and wherein the implementation of further travel up to a stop is suppressed as long as the minimum time period has not yet been reached.

4. The method according to claim 1, wherein at least one operating state variable of the internal combustion engine is registered, travel up to a stop is implemented in different operating states, the stop phase angle values ($\epsilon_{stop}$) which are respectively determined for the individual operating states are stored in a data memory, and in that a stop phase angle value ($\epsilon_{stop}$) is then determined for an operating state by reading out a stop phase angle value ($\epsilon_{stop}$) from the data memory as a function of the at least one operating state variable and using it to limit the phase angle signal ($\epsilon_{act}$) and/or setpoint phase angle signal ($\epsilon_{setp}$) and/or as a reference point for the phase angle signal ($\epsilon_{act}$).

5. The method of claim 4, wherein the operating state variable is its operating temperature and/or crankshaft rotational speed.

6. The method according to claim 1, wherein a phase speed signal for the changing of the phase angle is registered, and the phase speed signal is adjusted to a predefined setpoint phase speed signal during the travel up to a stop.

7. The method according to claim 1, wherein the phase angle is adjusted during the travel up to a stop.

8. The method according to claim 1, wherein the difference between the phase angle signal ($\epsilon_{act}$) and the stop phase angle value ($\epsilon_{stop}$) is determined, and the setpoint phase speed signal is changed as a function of the difference.

9. The method of claim 8, wherein the setpart phase speed signal is changed when the difference decreases.

10. The method according to claim 1, wherein the rotational speed of the adjusting shaft is limited during the travel up to a stop.

11. The method according to claim 1, wherein an electric motor is provided for driving the adjusting shaft, and during the travel up to a stop the operating current and/or the operating voltage of the electric motor are limited.

* * * * *